US005123719A

United States Patent [19]

Oden

[11] Patent Number: 5,123,719

[45] Date of Patent: Jun. 23, 1992

[54] GOLF BALL DISPENSER APPARATUS

[76] Inventor: Rick H. Oden, 29 William St., Addison, N.Y. 14801

[21] Appl. No.: 719,615

[22] Filed: Jun. 24, 1991

[51] Int. Cl.[5] ..... A47F 1/00

[52] U.S. Cl. ..... 312/49; 221/194; 83/929

[58] Field of Search ..... 312/42, 45, 49, 72, 312/73; 221/92, 191, 194, 281, 303, 307; 83/574, 660, 929; 211/14, 15, 59.2; 273/32 B

[56] References Cited

U.S. PATENT DOCUMENTS

| | | | |
|---|---|---|---|
| 689,394 | 12/1901 | Gregory | 83/660 X |
| 691,990 | 1/1902 | Warren | 221/191 X |
| 3,194,433 | 7/1965 | Heslov | 221/281 X |
| 3,744,866 | 7/1973 | Cook | 312/42 |
| 4,088,251 | 5/1978 | Rodriguez | 221/303 X |

FOREIGN PATENT DOCUMENTS

| | | | |
|---|---|---|---|
| 1008140 | 1/1950 | France | 312/42 |

*Primary Examiner*—Kenneth J. Dorner
*Assistant Examiner*—Brian K. Green
*Attorney, Agent, or Firm*—Leon Gilden

[57] ABSTRACT

A golf ball dispenser apparatus is arranged for accommodating plural columns of packages permitting ease of dispensing of the packages with separation of the packages and permitting removal of individual components therefrom.

2 Claims, 3 Drawing Sheets

GOLF BALL DISPENSER APPARATUS

BACKGROUND OF THE INVENTION

1. Field of the Invention

The field of invention relates to dispensing apparatus, and more particularly pertains to a new and improved golf ball dispensing apparatus wherein the same is arranged for dispensing packages or individual golf balls from containers.

2. Description of the Prior Art

In the display and sale of golf balls, individuals are encouraged to buy packages of a plurality of golf balls. Individuals not desiring to purchase or obtain such pluralities of golf balls in components are discouraged. The invention sets forth an organization to accommodate both complete packages and individual golf balls from the associated packages. Examples of prior art dispensing apparatus set forth in the prior art is exemplified in U.S. Pat. No. 3,869,137 to Byrom wherein a portable storage cart includes a column of removable ball members therefrom.

U.S. Pat. No. 4,917,282 to Hufford wherein a ball holder is formed of a resilient material, with apertures therewithin to resiliently secure various golf balls positioned therewithin.

As such, it may be appreciated that there continues to be a need for a new and improved golf ball dispenser apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dispensing apparatus now present in the prior art, the present invention provides a golf ball dispenser apparatus wherein the same is arranged for dispensing packages or individual golf ball members. As such, the general purpose of the present invention, which will be described subsequently in greater detail, is to provide a new and improved golf ball dispenser apparatus which has all the advantages of the prior art dispensing apparatus and none of the disadvantages.

To attain this, the present invention provides a golf ball dispenser apparatus arranged for accommodating plural columns of packages permitting ease of dispensing of the packages with separation of the packages and permitting removal of individual components therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved golf ball dispenser apparatus which may be easily and efficiently manufactured and marketed.

It is a further object of the present invention to provide a new and improved golf ball dispenser apparatus which is of a durable and reliable construction.

An even further object of the present invention is to provide a new and improved golf ball dispenser apparatus which is susceptible of a low cost of manufacture with regard to both materials and labor, and which accordingly is then susceptible of low prices of sale to the consuming public, thereby making such golf ball dispenser apparatus economically available to the buying public.

Still yet another object of the present invention is to provide a new and improved golf ball dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3:
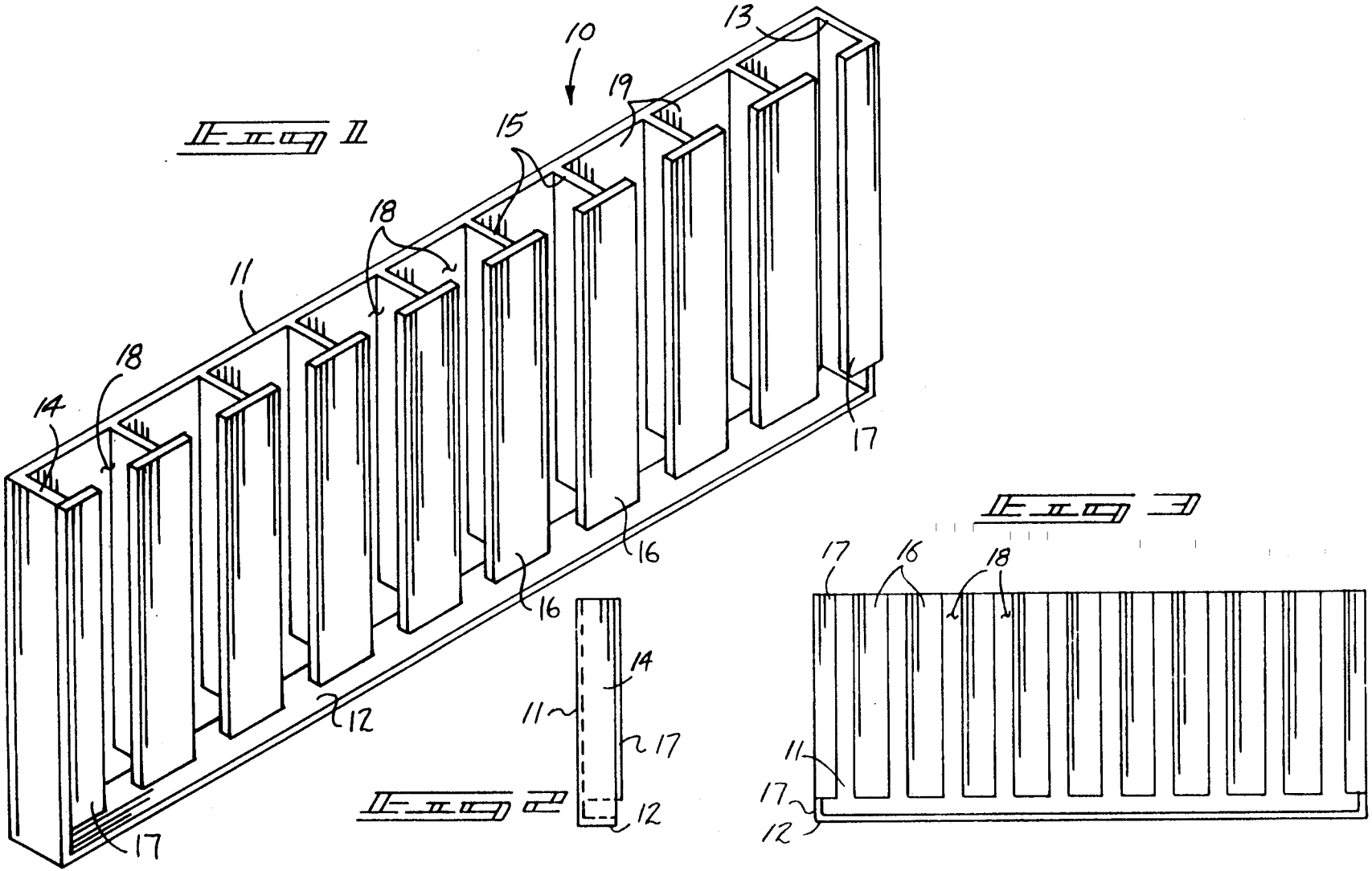
FIG. 1 is an isometric illustration of the instant invention.
FIG. 2 is an orthographic side view of the instant invention.
FIG. 3 is an orthographic frontal view, taken in elevation, of the instant invention.
Figure 3A:
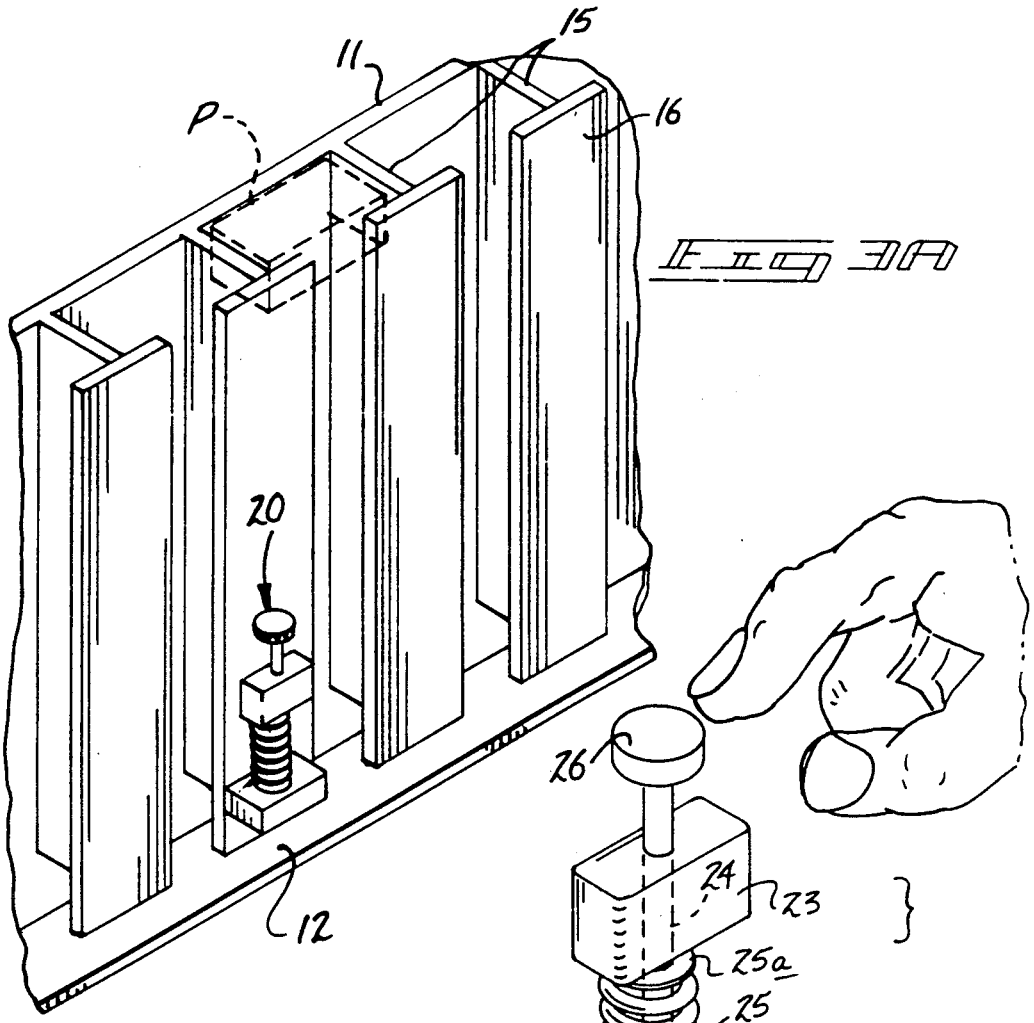
FIG. 3*a* is an isometric illustration of the invention mounting a severing tool thereon.

With reference now to the drawings, and in particular to FIGS. 1 to 6 thereof, a new and improved golf ball dispenser apparatus embodying the principles and concepts of the present invention and generally designated by the reference numeral 10 will be described.

Figure 4:
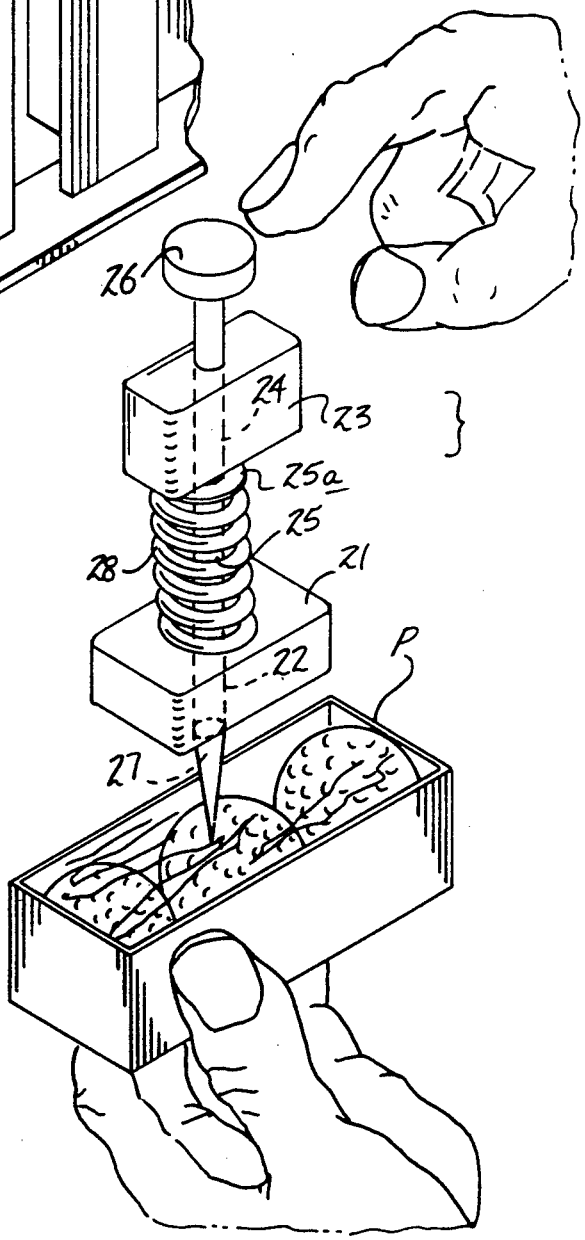
FIG. 4 is an isometric illustration, somewhat enlarged, of the severing tool utilized by the instant invention.
Figure 5:
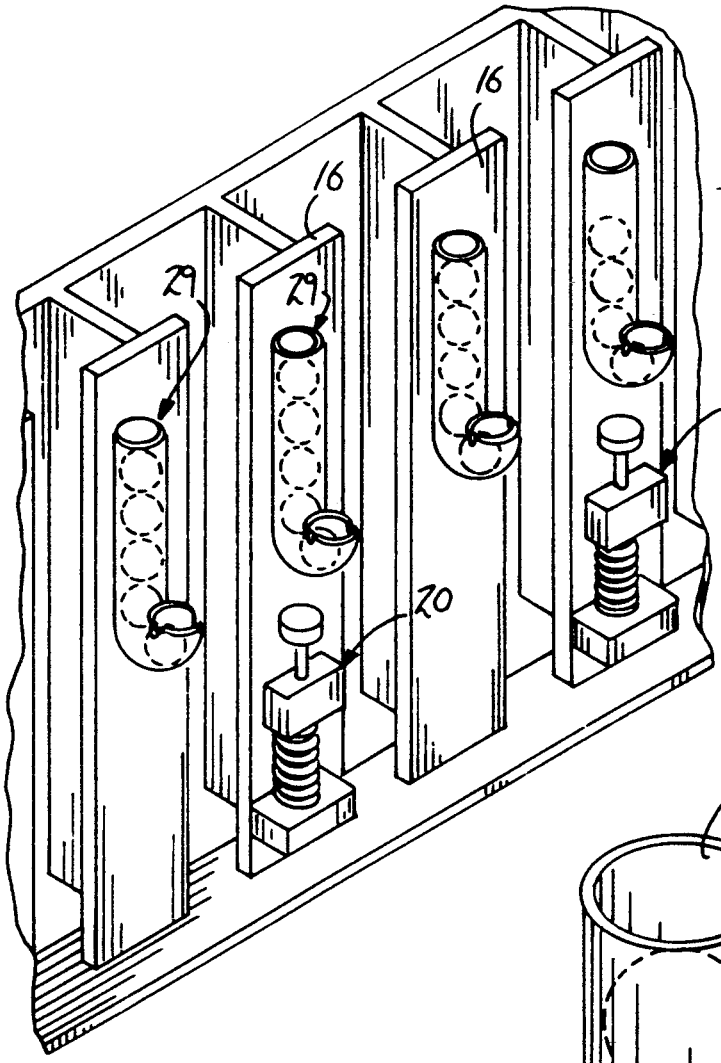
FIG. 5 is an isometric illustration of the apparatus utilizing golf magazine tubes.
Figure 6:
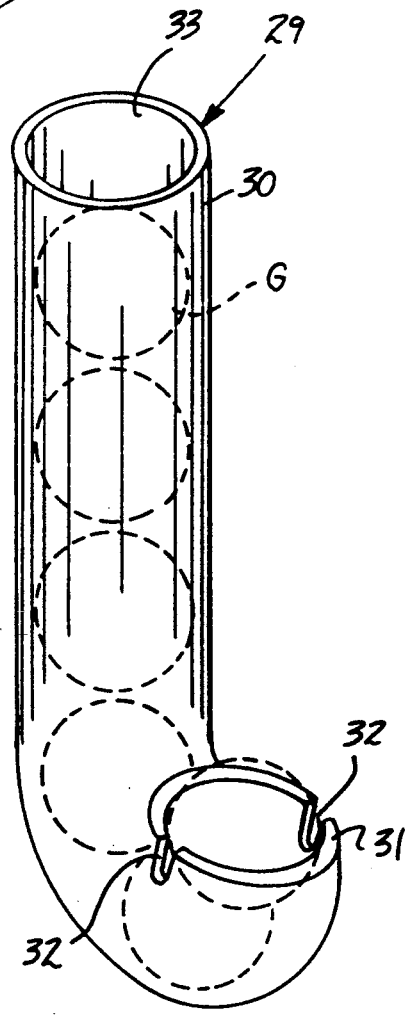
FIG. 6 is an enlarged isometric illustration of a magazine tube utilized by the instant invention.

More specifically, the golf ball dispenser apparatus 10 of the instant invention essentially comprises a housing including a rear wall 11, with a bottom wall 12 integrally and orthogonally mounted to a lower edge of the rear wall 11 extending coextensively thereof. The rear and bottom walls are each defined by a predetermined first length, with the rear wall defined by a first height. Respective right and left side walls 13 and 14 are orthogonally mounted to the rear wall 11 and bottom wall 12 and defined by a first height substantially equal to the first height defined by the side walls 13 and 14. A series of equally spaced partition walls 15 are fixedly and orthogonally mounted relative to the rear wall 11 extending from an upper terminal edge of the rear wall to a position spaced above a lower terminal edge of the rear wall. Partition walls 15 are accordingly arranged in a parallel relationship relative to one another and are defined by a second height less than the first height to space each partition wall above the bottom wall 12. Each partition wall 15 includes an abutment wall 16 orthogonally mounted and coextensive with each partition wall equal to a height defined by the second height, and accordingly are arranged parallel relative to the rear wall 11. Abutment end walls 17 are provided and mounted to a forward side edge of each side wall spaced from the rear wall 11, wherein the abutment walls 16 mounted to each side wall are of a width substantially equal to one-half a width of each partition wall and defined by a second height. In this manner, a gap 18 is defined between the coplanar partition walls and abutment walls providing access to a compartment 19 of a generally rectangular parallelepiped configuration to accommodate a plurality of packages "p", of a type as illustrated in FIGS. *3a* and 4. The packages "p" are stacked in columns within each of the compartments 19, wherein a lowermost package "p" is removed and each column thusly formed As the packages "p" normally contain a plurality of components such as golf balls therewithin and are typically formed with a polymeric type covering, a severing tool 20 is arranged in a modified construction of the invention mounted to a forward face of one of said abutment walls 16. Typically, the abutment walls 16 are arranged for receiving the severing tool 20 but if desired, an abutment end wall 17 may also accommodate the tool 20. The tool 20 includes a lower block 21 spaced from and positioned below an upper block 23 in a parallel relationship. The lower block 21 includes a lower bore 22, with the upper block 23 including an upper bore 24 that are coaxially aligned with a piercer rod 25 reciprocatably mounted between the lower and upper bores 22 and 24 to include a severing pointed lower end 27 projecting above the lower block, while a piercer rod head 26 projects above the upper block to enhance manual engagement and projection of the piercer rod from a first position spaced above the lower block to a second position below the lower block, as illustrated in FIG. 4. A spring member 28 is captured between the upper and lower blocks and is arranged to normally bias the piercer rod 26 into the upper raised position. A retainer plate 25*a* is fixedly mounted to the rod 25 to provide an operative retainer plate upon which the spring member 28 cooperates to effect upward biasing of the rod 25.

Subsequent to severing of the package "p", a removal of a single or plurality of balls therefrom and having golf balls remaining, such golf balls may be positioned within "J" shaped magazine tubes 29 secured to each forward face of an associated abutment wall 16. The "J" shaped tubes 29 include a primary tube 30 projecting into an upwardly curved lower tube that includes a tube outlet opening 31. The lower tube includes a plurality of diametrically aligned recesses 32 directed across a lower terminal end of the outlet tube 31 that is positioned below the upper entrance end of the primary tube 30. The tube entrance end 33 receives a column of the golf balls "G" therewithin, wherein the slots 32 permit ease of manual access to the golf balls for their individual removal from the "J" shaped magazine tube 29, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. A golf ball dispenser apparatus, comprising:

a housing, including a planar rear wall, with the planar rear wall including a wall top edge spaced from and parallel a wall bottom edge, and a bottom wall integrally and orthogonally mounted to the rear wall at the wall bottom edge coextensive with the rear wall, and a right side wall integrally and orthogonally mounted to a right side edge of the rear wall, and a left side wall integrally and orthogonally mounted to a left edge of the rear wall, wherein each side wall is coextensive to the rear wall, and a plurality of partition walls integrally and orthogonally mounted to the rear wall between the right side wall and left side wall, wherein the partition walls are arranged parallel relative to one another and integrally and orthogonally mounted to the rear wall extending downwardly from the wall top edge, and each partition wall defined by a second height, wherein the rear wall is defined by a first height, wherein the second height is less than the first height, and each partition wall including an abutment wall integrally and orthogonally mounted to each said partition wall at a spaced relationship relative to the rear wall, wherein each of the partition walls are coplanar, and the partition walls, the abutment walls, and the rear wall define compartments, and the partition walls are spaced apart a predetermined gap to provide manual access into each compartment, and each partition wall and each abutment wall is spaced above the bottom wall, and including at lest one severing tool mounted to a forward face of one of said partition walls exteriorly of the compartments, wherein the severing tool includes a lower block spaced from and parallel an upper block, the lower block includes a lower bore, the upper block includes an upper bore, wherein the upper and lower bore are coaxially aligned relative to one another, and a piercer rod reciprocatably mounted between the lower block and upper block within the lower bore and upper bore, the piercer rod including a severing and pointed lower end to effect piercing of packages contained within the compartments when removed therefrom, and a spring member captured between the lower block and the upper block to bias the piercer rod in a raised orientation to contain the lower end within the lower block, wherein the piercer rod is displaceable to a lower position to project the lower end below the lower block.

2. An apparatus as set forth in claim 1 including at least one magazine tube mounted to the forward face of at least one of said partition walls, wherein the magazine tube includes a primary tube in contiguous communication with a forward face, and a lower tube projecting upwardly from a lowermost portion of the primary tube, and the primary tube includes an inlet opening, and the lower tube includes an outlet opening, the outlet opening spaced below the inlet opening, the outlet opening including a plurality of diametrically aligned recesses permitting manual engagement of a golf ball member positioned within the magazine tube adjacent the outlet opening.

* * * * *